US006745650B1

(12) United States Patent
Chang

(10) Patent No.: US 6,745,650 B1
(45) Date of Patent: Jun. 8, 2004

(54) SPANNER HEAD ORIENTATION POSITIONING DEVICE

(76) Inventor: Tsung-Chieh Chang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/307,551

(22) Filed: Dec. 2, 2002

(51) Int. Cl.[7] ..... B25B 23/16
(52) U.S. Cl. ..... 81/177.8; 81/177.7
(58) Field of Search ..... 81/177.8, 177.1, 81/177.7, 489, 177.9; 403/103, 91, 97

(56) References Cited

U.S. PATENT DOCUMENTS 4,901,608 A * 2/1990 Shieh ..... 81/177.8
5,199,335 A * 4/1993 Arnold et al. ..... 81/177.8
5,820,288 A * 10/1998 Cole ..... 403/97
6,148,698 A * 11/2000 Hsieh ..... 81/177.8
6,295,898 B1 * 10/2001 Hsieh ..... 81/177.8
6,386,075 B1 * 5/2002 Shiao ..... 81/177.8
2003/0188608 A1 * 10/2003 Hsien ..... 81/177.8

* cited by examiner

*Primary Examiner*—Lee D. Wilson

(57) ABSTRACT

A spanner head orientation positioning device comprises a spanner head, a handle, and a buckle. One end of the spanner head has a convex pivotal end. The pivotal end has an axial hole; and one outer end of the pivotal end has an inclined cambered surface. The buckle is installed between the spanner head and the handle and is a block; one end of the buckle with respect to the spanner head is formed with a concave cambered surface. The cambered surface has a configuration corresponding to the inclined cambered surface of the handle. Thereby, by above components, the buckle slides between two sides of the concave cambered surface, and thus an orientation of the handle is adjustable.

5 Claims, 9 Drawing Sheets

SPANNER HEAD ORIENTATION POSITIONING DEVICE

FIELD OF THE INVENTION

The present invention relates to spanners, and particularly to a spanner head orientation positioning device, wherein the orientation of the spanner can be adjusted easily.

BACKGROUND OF THE INVENTION

Referring to FIG. 1, a prior art spanner is illustrated. It is illustrated that a buckle is installed between a handle and a spanner head of the spanner. One protruding end surface of the handle is formed with one teeth portion and one smooth portion. Another end of the buckle with respect to the protruding end surface of the handle is formed with a Y shape coupling portion. The buckle is slidable along the protruding end so as to adjust the orientation and position of the spanner head.

In above mentioned structure, the adjustment is affected by the teeth width of the spanner head, and thus the positioning operation is affected. That is, the user must adjust the position to match the engagement of the teeth. As a consequence the orientation of the spanner head is affected and possibly it is not a desired value. Thereby, the orientation of the spanner head is confined by the teeth portion.

SUMMARY OF THE INVENTION

Accordingly, the primary object of the present invention is to provide a spanner head orientation positioning device comprises a spanner head, a handle, and a buckle. One end of the spanner head has a convex pivotal end. The pivotal end has an axial hole; one outer end of the pivotal end has an inclined cambered surface. The buckle is installed between the spanner head and the handle and is a block. One end of the buckle with respect to the spanner head is formed with a concave cambered surface. The cambered surface has a configuration corresponding to the inclined cambered surface of the handle. Thereby, by above components, the buckle slides between two sides of the concave cambered surface, and thus an orientation of the handle is adjustable.

The various objects and advantages of the present invention will be more readily understood from the following detailed description when read in conjunction with the appended drawing.

DETAILED DESCRIPTION OF THE PREFERRED EMBODIMENTS

Figure 1:
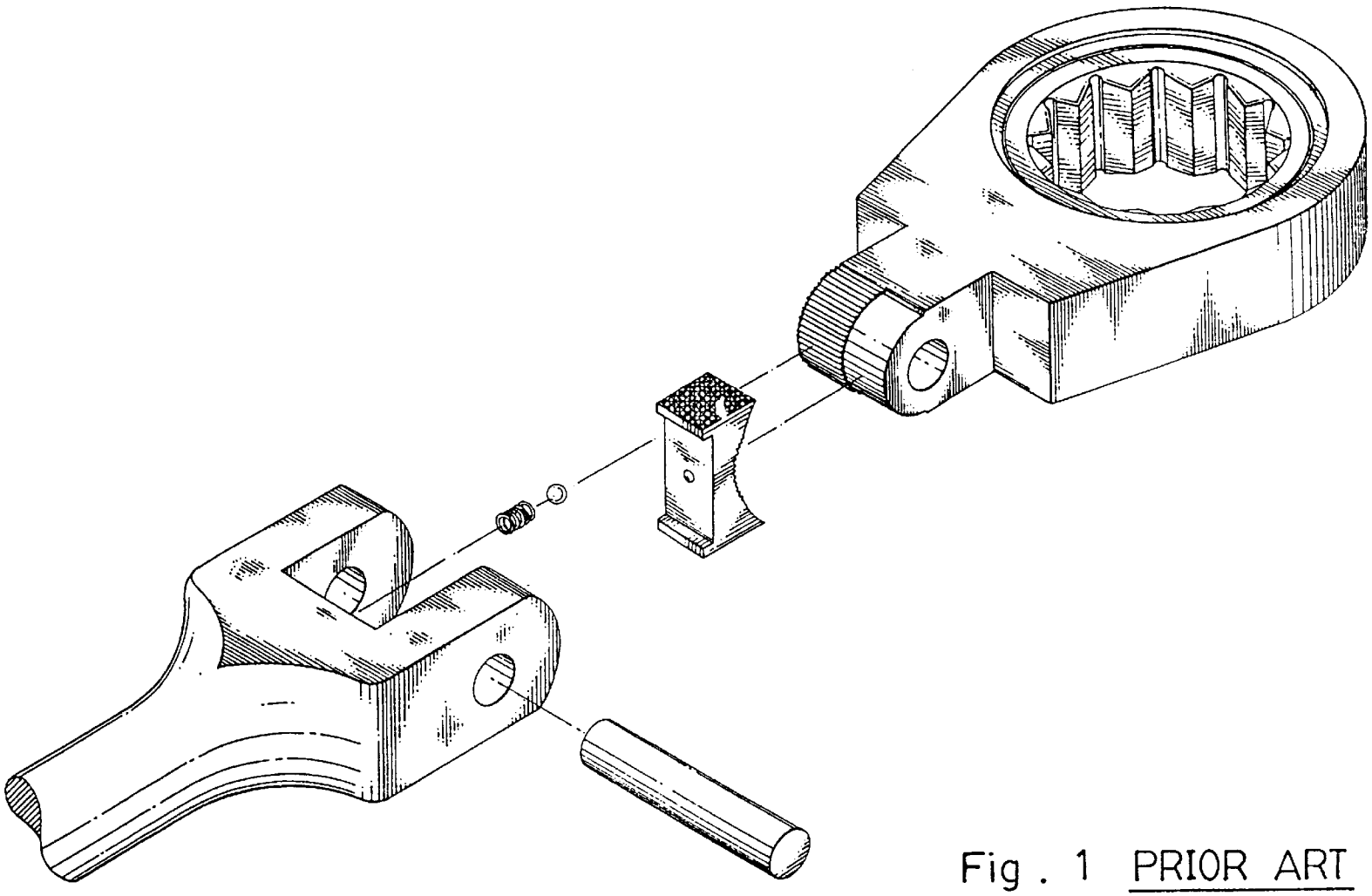
Fig. 1 PRIOR ART
FIG. 1 is an exploded schematic view of a prior art.
Figure 2:
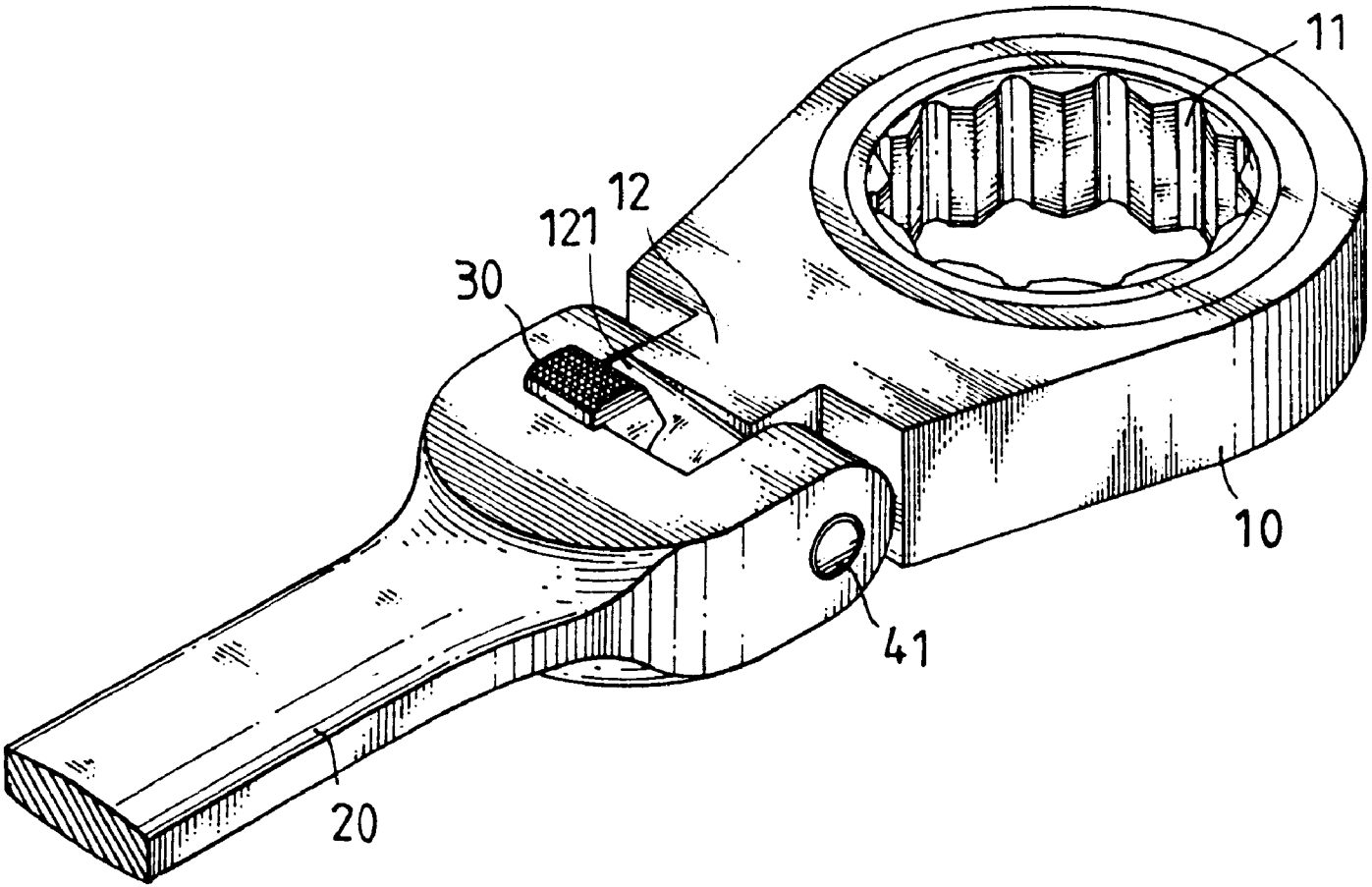
FIG. 2 is a schematic perspective view of the present invention.
Figure 3:
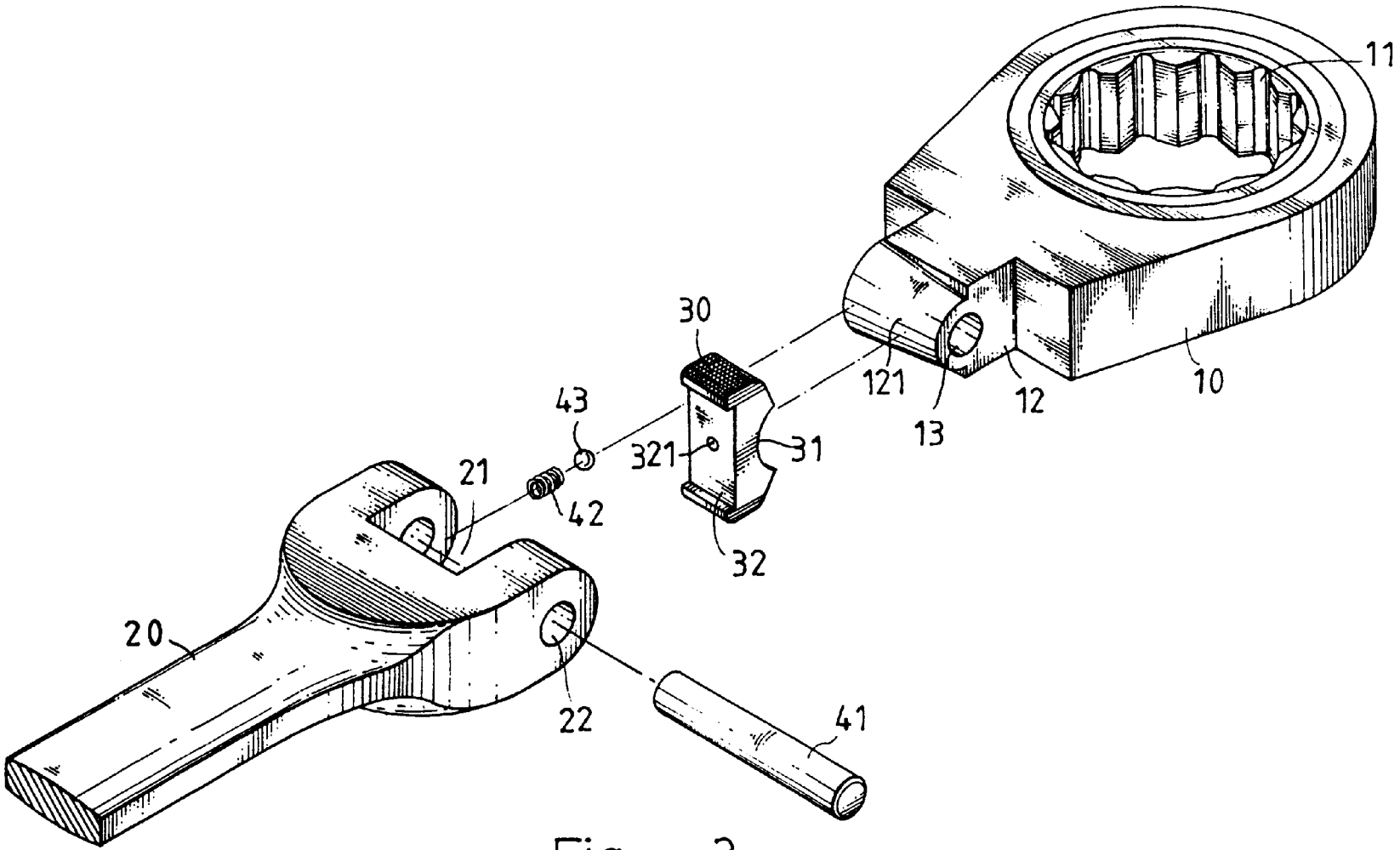
FIG. 3 is an exploded schematic view of the present invention.

Referring to FIGS. 2 to 6, the spanner head orientation positioning device of the present invention is illustrated. The device includes a spanner head 10, a handle 20, and a buckle 30.

The spanner head 10 has a cambered head 10. One end of the spanner head 10 has an engaging opening 11 for being engaging with a screw element. Another end of the spanner head 10 has a convex pivotal end 12. The pivotal end 12 has an axial hole 13. One outer end of the pivotal end 12 has an inclined cambered surface 121.

One end of the handle 20 is a long handle and another end thereof is a U shape connecting end 21. Two sides of the connecting end are formed with through holes 22. A shaft 41 with texture on a periphery thereof passes through the through holes 22 and axial hole 13 of the spanner head 10. The interior of the handle 20 has a groove 211 for receiving an elastomer 42 and a steel ball 32. The steel ball 43 slightly protrudes from the groove 211 by the rejection of the elastomer 42.

The buckle 30 is installed between the spanner head 10 and the handle 20 and is a block. One end of the buckle 30 with respect to the spanner head 10 is formed with a concave cambered surface 31. The cambered surface has a configuration corresponding to the inclined cambered surface 31 of the handle 20. Another end of the buckle 30 with respect to the handle 20 has a trench 32 having a U like shape. The trench 32 runs across the connecting end 21 and is slidable thereon. An interior wall of the trench 32 has a hole 321. The steel ball 43 can be positioned in the hole 321.

Figure 4:
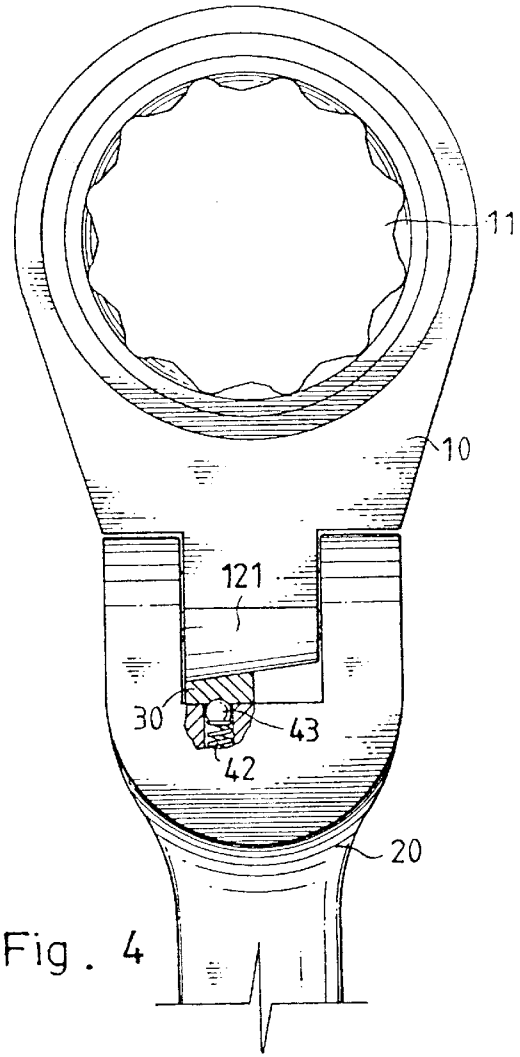
FIG. 4 is a schematic cross sectional view of the present invention.
Figure 5:
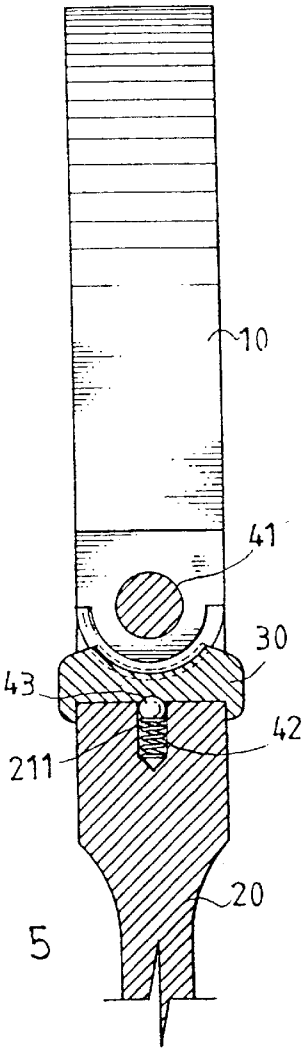
FIG. 5 is another schematic cross sectional view of the present invention.
Figure 6:
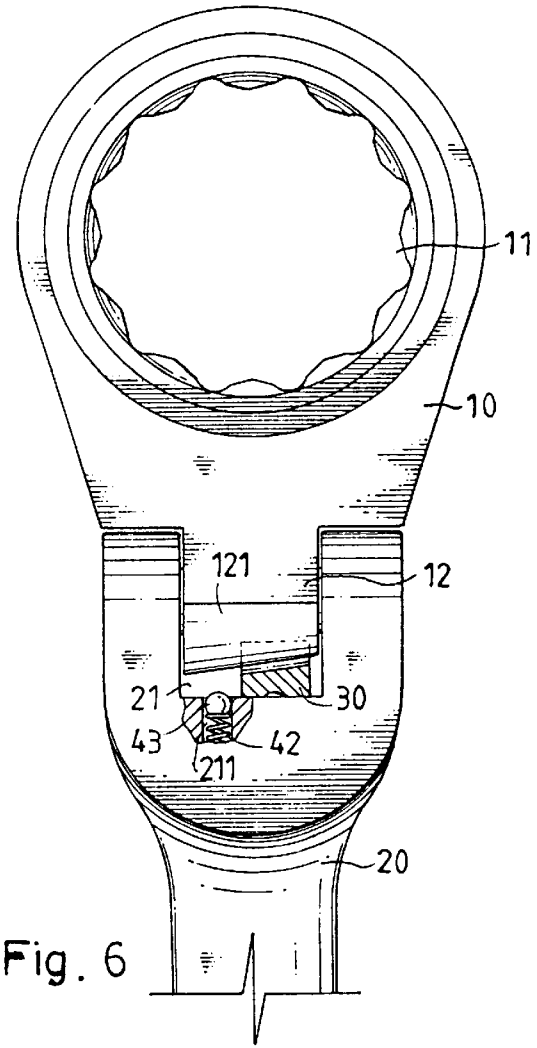
FIG. 6 shows that the orientation of the present invention is adjustable.
Figure 7:
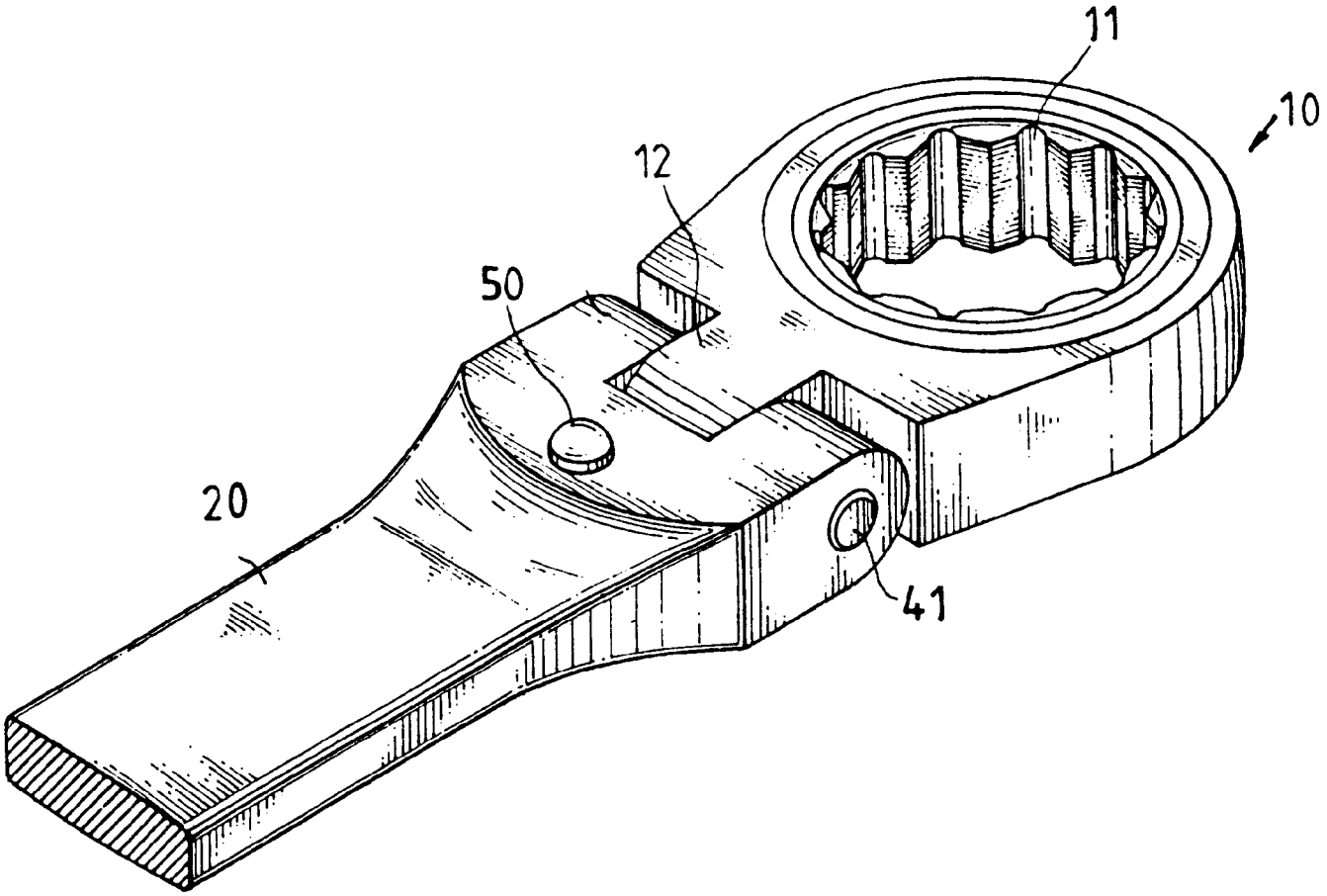
FIG. 7 is a schematic view of the second embodiment of the present invention.
Figure 8:
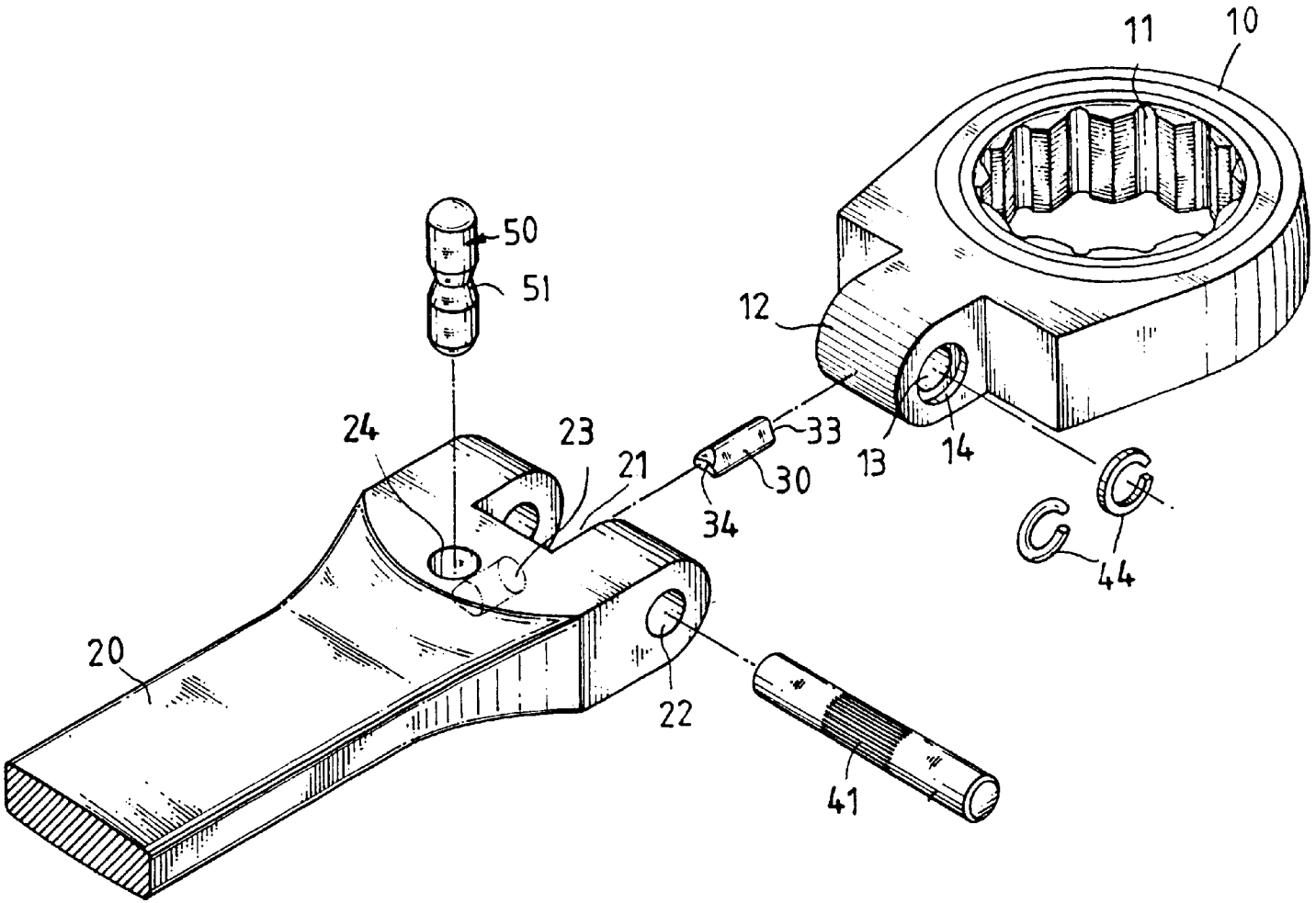
FIG. 8 is an exploded schematic view of the second embodiment of the present invention.

Thereby, by above components, when the spanner head 10 is bent with respect to the handle 20, and then they are positioned by the buckle 30, as shown in FIGS. 4 and 6. When the buckle 30 slides to a higher place of the spanner head 10 and the inclined cambered surface 121. The orientation of the spanner head 10 is adjustable. When the buckle 30 slides to a lower place, the orientation of the spanner head 10 is fixed. Thereby, the present invention is more convenient that the prior art.

Referring to FIGS. 7 to 12, in this embodiment, the buckle 30 of the present invention is a rod having a triangular cross section. One end of buckle 30 with respect to the spanner head 10 has a cambered end 33 and another end with respect to the handle 20 has a V shape end surface 34. To match the configuration of the buckle 30, the inclined cambered surface 121 of the pivotal end 12 of the spanner head 10 is a plane, and a center of the connecting end of the handle 20 has a receiving groove 23 for receiving the buckle 30. At the same time, an outer surface of the buckle 30 vertical to the receiving groove 23 is formed with an axial hole 24 which is communicated with the groove 23. Thereby, an adjusting means 50 can be received therein. The adjusting means 50 is a round rod. A middle section of the adjusting means 50 has a V shape annular groove 51 which is exactly coupled to the V shape end surface 34 of the buckle 30. When the adjusting means 50 is shifted rightwards or leftwards, any side of the V shape annular groove 51 tightly resists against the V shape end surface 34. Thereby, the spanner head 10 can be adjusted to another orientation and is positioned therein.

Figure 11:
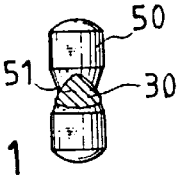
FIG. 11 is an assembled cross sectional view showing that the buckle and the adjusting means are tightly engaged and positioned in the second embodiment of embodiment.
Figure 9:
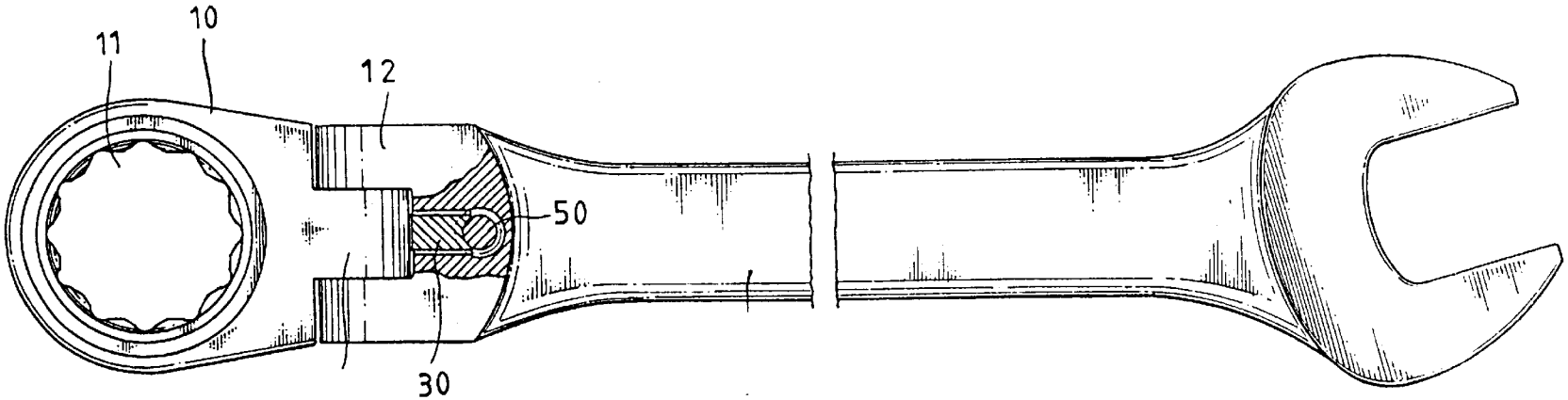
FIG. 9 is an assembled cross sectional view of the second embodiment of the present invention.
Figure 10:
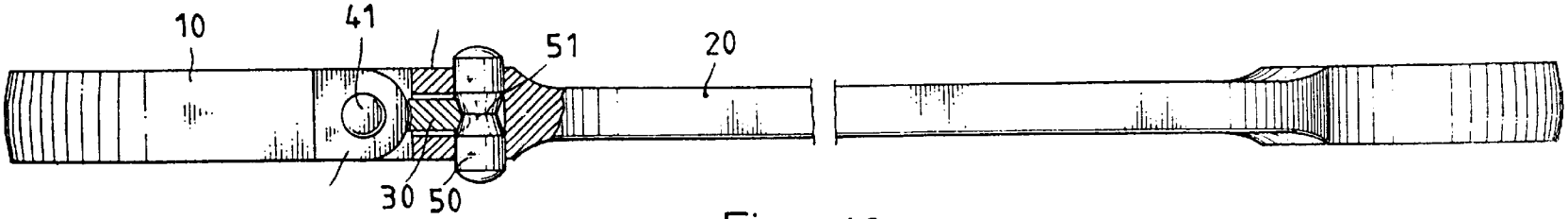
FIG. 10 is a schematic cross sectional view of the second embodiment in that the spanner head is not adjusted and not positioned.
Figure 12:
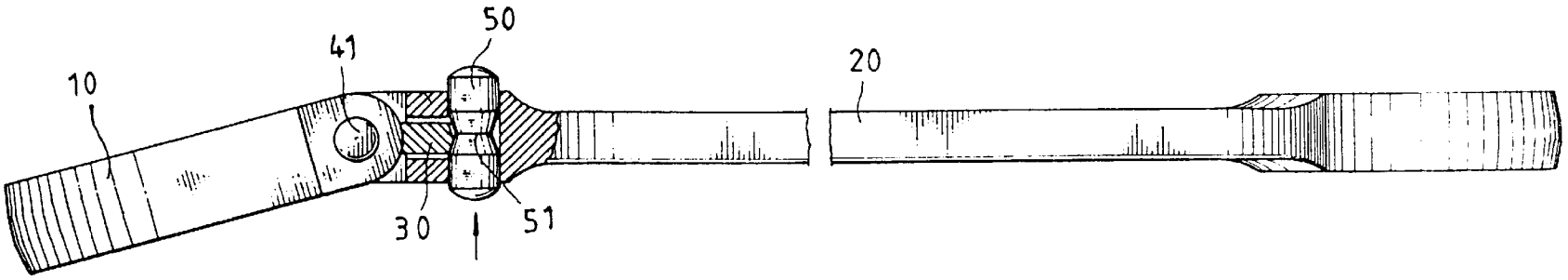
FIG. 12 is an operation schematic view of the second embodiment of the present invention where the orientation of the spanner head is adjusted and the spanner head is positioned.

Referring to FIGS. 10 to 12, when the spanner head 10 of the present invention is not be positioned, V shape annular groove 51 of the adjusting means 50 is not in contact with the buckle 30 (referring to FIG. 10). When it is desired to fix the orientation of the spanner head 10, it is only necessary to shift the spanner head 10 rightwards or leftwards, the reducing surface of the V shape annular groove 51 is tightly engaged with the V shape end surface 34 of the buckle 30 (referring to FIG. 12). Thereby, the cambered surface 33 of the buckle 30 resists against the outer surface of the pivotal end 12. Thus, the orientation of the spanner head 10 can be adjusted by one hand.

Moreover, to increase the stability of the structure, each of the two outer sides of the axial hole 13 of the spanner head 10 is formed with an enlarged hole. Thus, a C shape elastomer 44 can be buckled therein.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A spanner head orientation positioning device comprising a spanner head, a handle, and a buckle; wherein:

one end of the spanner head has an engaging opening for being engaging with a screw element; another end of the spanner head has a convex pivotal end; the pivotal end has an axial hole; one outer end of the pivotal end has an inclined cambered surface;

one end of the handle is a long handle and another end thereof is a U shape connecting end; two sides of the connecting end are formed with through holes; a shaft on a periphery thereof passes through the through holes and axial hole of the spanner head;

the buckle is installed between the spanner head and the handle and is a block; one end of the buckle with respect to the spanner head is formed with a concave cambered surface; the cambered surface has a configuration corresponding to the inclined cambered surface of the handle; another end of the buckle with respect to the handle has a trench having a U like shape; the trench runs across the connecting end and is slidable thereon; and thereby, by above components, the buckle slides between two sides of the concave cambered surface, and thus an orientation of the handle is adjustable.

2. The spanner head orientation positioning device as claimed in claim 1, wherein an interior of the handle has a groove for receiving an elastomer and a steel ball; the steel ball slightly protrudes from the groove; an interior wall of the trench has a hole; and the steel ball protroded from the groove is inserted into the hole.

3. A spanner head orientation positioning device comprising a spanner head, a handle, and a buckle; comprising:

one end of the spanner head has an engaging opening for being engaging with a screw element; another end of the spanner head has a convex pivotal end; the pivotal end has an axial hole; one outer end of the pivotal end has an inclined cambered surface;

one end of the handle is a long handle and another end thereof is a U shape connecting end; two sides of the connecting end are formed with through holes; a shaft on a periphery thereof passes through the through holes and axial hole of the spanner head;

the buckle is a rod having a triangular cross section; one end of buckle with respect to the spanner head has a cambered end and another end with respect to the handle has a V shape end surface; to match the configuration of the buckle, the inclined cambered surface of the pivotal end of the spanner head is a plane, and a center of the connecting end of the handle has a receiving groove for receiving the buckle; at the same time, an outer surface of the buckle vertical to the receiving groove is formed with an axial hole which is communicated with the groove; thereby, an adjusting means is received therein; the adjusting means is a round rod; a middle section of the adjusting means has a V shape annular groove which is exactly coupled to the V shape end surface of the buckle; when the adjusting means is shifted rightwards or leftwards, any side of the V shape annular groove tightly resists against the V shape end surface; hereby, the spanner head is adjustable to another orientation and is positioned therein;

thereby, by above components, the buckle slides between two sides of the concave cambered surface, and thus an orientation of the handle is adjustable.

4. The spanner head orientation positioning device as claimed in claim 1, wherein the two outer sides of the axial hole of the spanner head are formed respective enlarged holes; and a C shape elastomer is buckled therein.

5. The spanner head orientation positioning device as claimed in claim 3, wherein the two outer sides of the axial hole of the spanner head are formed respective enlarged holes; and a C shape elastomer is buckled therein.

* * * * *